United States Patent [19]

Beckworth et al.

[11] 4,420,389

[45] Dec. 13, 1983

[54] DE-ASHING LUBRICATING OILS

[75] Inventors: Alden E. Beckworth; Jerald A. Howell; Donald C. Tabler, all of Bartlesville, Okla.

[73] Assignee: Phillips Petroleum Company, Bartlesville, Okla.

[21] Appl. No.: 417,937

[22] Filed: Sep. 14, 1982

[51] Int. Cl.[3] ..... C10G 17/00; C10G 9/12; C10G 9/16; C10M 11/00

[52] U.S. Cl. ..... 208/251 R; 208/179; 208/48 R

[58] Field of Search ..... 208/251 R, 179, 48 R

[56] References Cited

U.S. PATENT DOCUMENTS

| | | | |
|---|---|---|---|
| 1,783,697 | 12/1930 | Brink et al. | 208/182 |
| 2,045,216 | 6/1936 | Crowley et al. | 208/182 |
| 2,762,754 | 9/1956 | Offutt et al. | 208/182 |
| 3,790,474 | 2/1974 | Moffitt | 208/181 |
| 3,904,512 | 9/1975 | Clark | 208/182 |
| 3,923,643 | 12/1975 | Lewis et al. | 208/179 |
| 3,930,988 | 1/1976 | Johnson | 208/182 |
| 4,151,072 | 4/1979 | Nowack et al. | 208/182 |
| 4,247,389 | 1/1981 | Johnson | 208/181 |
| 4,265,733 | 5/1981 | Gabler et al. | 208/179 |
| 4,381,992 | 5/1983 | Wood et al. | 208/179 |

OTHER PUBLICATIONS

W. L. Nelson, *Petrol. Refining and Engineering,* 4 ed., pp. 682 and 683.

M. Akbar, *Hydrocarbon Processing,* May 1981, p. 81.

*Primary Examiner*—Delbert E. Gantz

*Assistant Examiner*—Helane E. Maull

[57] ABSTRACT

In a process for producing an essentially ash-free oil stock from a lubricating oil containing ash forming components comprising reacting the oil with an aqueous ammonium salt capable of reacting with the ash-containing components and heating the thus treated oil at a temperature in the range of about 300° C. to about 420° C. to increase the amount of the ash-forming components removed, the improvement comprising not exposing the oil to a temperature greater than 200° C. before the oil is passed into a large volume of the oil already at a temperature in the range of about 300° C. to about 400° C.

9 Claims, 1 Drawing Figure

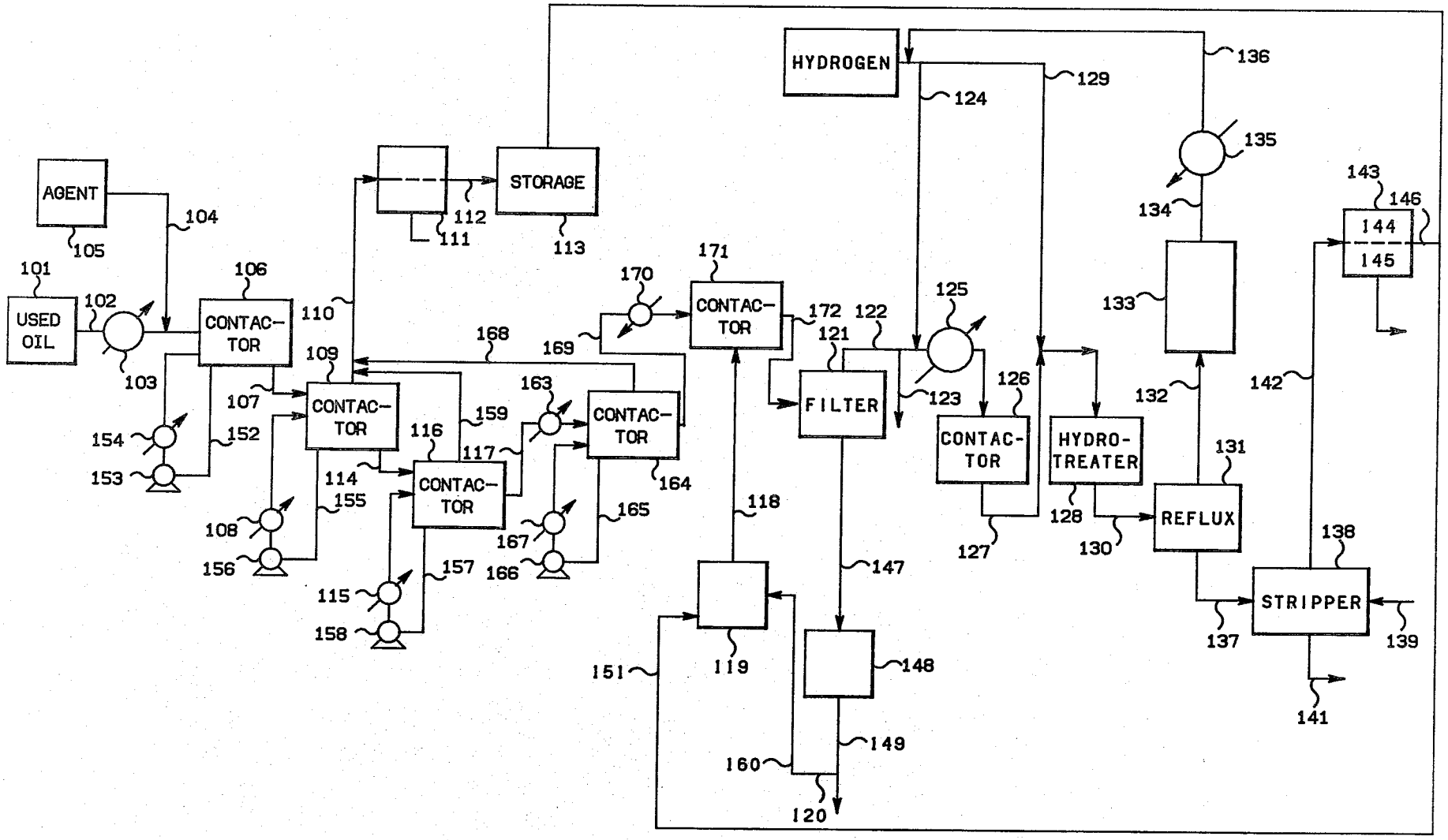
USED OIL
AGENT
CONTAC-TOR
STORAGE
HYDROGEN
FILTER
HYDRO-TREATER
REFLUX
STRIPPER
101
102
103
104
105
106
107
108
109
110
111
112
113
114
115
116
117
118
119
120
121
122
123
124
125
126
127
128
129
130
131
132
133
134
135
136
137
138
139
141
142
143
144
145
146
147
148
149
151
152
153
154
155
156
157
158
159
160
163
164
165
166
167
168
169
170
171
172

DE-ASHING LUBRICATING OILS

BACKGROUND OF THE INVENTION

This invention relates to a method for reducing the ash-content of lubricating oil containing ash-forming components. In another aspect this invention relates to a method for the treatment of used lubricating oils to obtain purified oil suitable for use as fuel oil, in grease formulations, or in the preparation of lubricating oil formulations.

Used motor oil has been estimated as being generated in the United States at a rate of about 1.1 billion gallons per year. Some of this used oil has been used as furnace oil and some has been used on rural dirt roads for dust control. Much of the oil has been merely discarded in sewers, dumps, and back alleys. With the ever decreasing petroleum reserves, it becomes more and more essential that this used oil be saved and used as long as possible.

One major obstacle to re-use of used oil in many applications involves the presence of various ash-forming impurities that remain dispersed in the oil due to the very effective dispersant characteristics of the additives in modern day lubricant systems.

Materials contained in a typical used crankcase oil that are considered to contribute to the ash content of the oil include sub-micron size carbon particles, inorganic materials such as atmospheric dust, metal particles, lead and other metal compounds originating from fuel combustion. Besides lead, which is generally present at concentrations of 1.0 to 2.5 weight percent, appreciable amounts of zinc, barium, calcium, phosphorus and iron are also present in the used crankcase oil. Examination of the used oil under an optical microscope at 600 magnifications reveals the very effective dispersant characteristics of modern day lube oils. The particle size of the particulates is estimated from this microscopic examination to be 0.1–1.0 microns with virtually no occurrence of agglomerates in the oil.

The presence of the ash-forming components in used oil puts limits on the extent to which the material can be used economically without ecological damage. For example, reuse of the used oil as fuel oil can give rise to serious atmospheric pollution when the oil contains in excess of one percent lead. Also, such fuel oil often results in burner and refractory maintenance costs that offset the purchase price differential between used oil and regular furnace oil.

Clearly, it is in the national interest to provide economical ways of removing the impurities from used oil so that it can be reused practically.

Recently, a technique of purifying used oil has been developed in which the used oil is reacted with an aqueous solution of an ammonium salt treating agent, then the water phase is removed, and the resulting oil phase-containing mass is separated by filtration. Such a technique is described in U.S. Pat. No. 4,151,072, the disclosure of which is incorporated herein by reference.

An improvement upon the process of U.S. Pat. No. 4,151,072 is disclosed in U.S. Pat. No. 4,247,389, the disclosure of which is also incorporated herein by reference. The improvement of this latter patent involved the use of a heat soak step wherein the oil after having the water removed was allowed to soak for a time at a relatively high temperature prior to being filtered. The high temperature heat soak step resulted in an improvement in the amounts of ash-forming components that could be separated from the oil.

In the initial commercial development of the process of U.S. Pat. No. 4,247,389, the oil after having substantially all the water removed was heated to the soaking temperature by being passed through a heating coil located in a furnace and then passed to a heat soaking vessel wherein a large volume of the hot oil was maintained at an elevated temperature for the required length of time. One drawback in this process was the fact that even though the oil was not being heated to a temperature at which any significant amounts of cracking would be expected to occur, some fouling of the heating coil did occur possibly as a result of the formation of decomposition products which adhered to the walls of the heating coil. In some instances, the extent of the fouling was so serious that it became the limiting factor on the length of time that the process could be effectively carried out.

An object of the present invention is to provide an improved method for carrying out the heat soak step in such an oil refining process.

SUMMARY OF THE INVENTION

In accordance with the present invention, there is provided a process for producing an essentially ash-free oil stock from a lubricating oil containing ash-forming components comprising reacting the oil with an aqueous ammonium salt capable of reacting with the ash-containing components and heating the thus treated oil at a temperature in the range of about 300° C. to about 420° C. for a period of time sufficient to increase the amount of the ash-forming components removed, the improvement comprising not exposing the oil to a temperature greater than 200° C. before the oil is passed into a large volume of the oil already at a temperature in the range of about 300° C. to about 420° C.

DETAILED DESCRIPTION OF THE INVENTION

The present invention provides an improvement for a process for refining a lubricating oil containing ash-forming components which process comprises:

(a) contacting said lubricating oil with an aqueous solution of a treating agent comprising a suitable ammonium salt under conditions of temperature, pressure, and time sufficient to disperse said agent in said lubricating oil and to react said agent with ash-forming components of said lubricating oil;

(b) removing a major portion of the water from the mixture resulting from combining said aqueous solution and said lubricating oil;

(c) heating at least a portion of the product resulting from step (b) at a temperature in the range of about 300° to about 420° C. for a period of time sufficient to increase the amount of ash-forming components that can be removed from the oil;

(d) cooling the product from step (c) to a temperature in the range of about 100° to about 180° C.; and (e) separating solids from the product of step (d). The improvement comprises conducting step (c) by passing the oil from step (b) into soaking vessel containing a large volume of said oil having a soaking temperature in the range of about 300° C. to about 420° C. before the oil from step (b) is heated to a temperature higher than 200° C. and passing portions of said large volume of heated oil through a heating coil wherein said oil is heated to a temperature in the range of 300° C. to 420°

C. and recycled to said soaking vessel wherein the residence time for the oil in said soaking vessel is such that the fouling of the heating coil is less than it would be if the oil from step (b) were heated to the same temperature by being passed directly through the heating coil.

The present invention is applicable to the de-ashing of oil in which ash forming components can be rendered removable by the treating agent. The invention is particularly applicable to the purification of oils that have been used for internal combustion engine lubrication purposes such as crankcase oils, e.g., in gasoline engines or diesel engines. Other sources of used oils include steam-turbine oils, transmission and gear oils, steam-engine oils, hydraulic oils, heat-transfer oils and the like.

The oils generally used for preparing internal combustion engine lubricants are the refinery lubricating cuts from paraffin-base, mixed-base, or naphthenic crudes. Their viscosities are generally in the range of from about 100 to about 1,800 SUS at 100° F. The oils also contain various additives such as oxidation inhibitors (e.g., barium, calcium and zinc alkyl thiophosphates, di-t-butyl-p-cresol, etc.), anti-wear agents (e.g., organic lead compounds such as lead diorganophosphorodithioates, zinc dialkyldithiophosphates, etc.), rust inhibitors (e.g., calcium and sodium sulfonates, etc.), dispersants (e.g., calcium and barium sulfonates and phenoxides, etc.), viscosity index improvers (e.g., polyisobutylenes, poly-(alkylstyrenes), etc.), detergents (e.g., calcium and barium salts of alkyl benzene sulfonic acids) and ashless-type detergents such as alkyl-substituted succinimides, etc.

If desired, water entrained in the untreated used lubricating oil can be removed before use of same in the process of this invention. Such a separation can be readily achieved by removal of the water phase which may occur in the storage tanks for the used lubricating oil.

The ammonium salt treating agents which are useful in the process of the present invention are those selected from the group consisting of ammonium sulfate, ammonium bisulfate, ammonium phosphate, diammonium hydrogen phosphate, ammonium dihydrogen phosphate, ammonium thiosulfate, ammonium polyphosphates such as ammonium metaphosphate, urea sulfate, guanidine sulfate, urea phosphate, and guanidine phosphate, and mixtures thereof. Said treating agents can be formed in situ if desired as, for example, by combining ammonia and/or ammonium hydroxide with sulfuric acid and/or phosphoric acid and/or an ammonium hydrogen sulfate or phosphate, i.e., ammonium bisulfate, diammonium hydrogen phosphate, and/or ammonium dihydrogen phosphate. When the treating agent is formed in situ, the reactants employed can be introduced at the same time, or one after the other.

Although the concentration of treating agent in the aqueous solution of treating agent is not critical and more dilute solutions can be used, the economics of the process are enhanced by the use of relatively concentrated solutions in order that the amount of water to be removed subsequently will not be great. Generally, the concentration of treating agent in the aqueous solution will be within the range of about 30 to about 95 weight percent, typically about 80 weight percent, of that in an aqueous solution that is saturated with the treating agent at 25° C. Frequently some water will be found in used oil, and in these instances the concentration of the treating agent can be adjusted accordingly.

In the process of this invention, the treating agent should preferably be employed in an amount at least sufficient to react with essentially all of the metal constituents in the used oil. Although the weight ratio of the treating agent to the oil can vary greatly, depending in part upon the nature and concentration of metal-containing components in the oil and on the particular treating agent employed, generally it will be within the range of about 0.002:1 to about 0.05:1, most often being within the range of about 0.005:1 to about 0.015:1, and typically being about 0.01:1. Although larger amounts of treating agent can be used, in most instances this would be wasteful of treating agent.

Water can be removed from the mixture resulting from the combination of the aqueous solution and the oil by any suitable means. Distillation is the referred method of removing water. Generally, the distillation is carried out at a temperature in the range of about 100° to about 140° C. and a pressure in the range of about 5 to about 25 psig for a period of time sufficient to effect removal of a major portion of the water. Light hydrocarbons contained in the oil that boil under the distillation conditions, e.g., gasoline, will be, of course, separated from the oil along with the water.

It is theorized that the heating step (c) results in an increased separation in the ash-forming components as a result of the decomposition of ammonium salts of sulfonic acid and/or dialkyldithiophosphoric acids that are present in the oil.

The heating in step (c) is preferably carried out at a temperature in the range of about 340° to about 370° C. Generally, the time that a volume of oil will be exposed to heat step (c) will be in the range of about 5 minutes to about an hour, more preferably about 15 minutes to about 30 minutes.

The solids are preferably separated from the product of step (d) by filtering. Generally, it is desirable to use a filter aid in the separation process. Filter aids which are useful in the practice of this invention include those selected from the group consisting of diatomaceous earth, perlite, and cellulose fibers. Presently preferred is diatomaceous earth.

The present invention is particularly useful in a process for converting a used oil into premium stock for the preparation of new lubricating oil. In accordance with such a process, the essentially ash free oil stock from step (e) of this invention is subjected to hydrotreating in the presence of hydrogen and a hydrotreating catalyst under conditions of temperature and pressure and time sufficient to produce a hydrotreated oil stock substantially free of organic heteroatom compounds and then stripping the hydrotreated oil to drive off light compounds boiling below the lube oil stock range.

FIG. 1 provides a schematic representation of a process in which the present invention can be applied. Referring now to FIG. 1, used oil from storage tank 101 is passed via line 102 to heater 103 and contactor 106. Aqueous treating agent such as diammonium hydrogen phosphate from makeup tank 105 is introduced via line 104. If desired, agent precursors ammonia, phosphoric acid, and water can be introduced into the heated oil downstream of heater 103, thereby forming the treating agent in situ in line 102 and contactor 106. The oil from heater 103 is passed in admixture with treating agent into the first agitated contactor 106 wherein the mixture is maintained under agitation for a time sufficient to react with at least a portion of the ash-forming components in the oil. Preferably, a recycle stream is passed through conduit 152 to pump 153 and then through heater 154 before its return to contactor 106, thereby providing heat and agiation to the contents of the contactor. Stirring means also can be employed.

Thereafter the mixture is passed via conduit 107 to second contactor 109, which is maintained at a temperature in the range of about 110° to about 140° C., for a time sufficient to effect distillation of a major portion of the water and at least some of the light hydrocarbons present therein. Thus, while retained in contactor 109, essentially all of the water and at least a portion of the light hydrocarbon components of the mixture are removed via line 110 and passed to separator 111 wherein a hydrocarbon layer and a water layer are allowed to form. The hydrocarbon phase can then be transferred via line 112 to storage 113. The water layer can be removed and discarded or employed for any desired purpose. Preferably, a recycle stream is passed through conduit 155 to pump 156 and then through heater 108 before its return to contactor 109, thereby providing heat and agitation to the contents of the reactor. Stirring means also can be employed.

The resulting mixture comprising a hot oil phase which is essentially free of water is passed via conduit 114 to a third contactor wherein it is subjected to agitation and a temperature in the range of about 140° to about 200° C. to remove additional water and lighter components. Preferably, a recycle stream is passed through conduit 157 to pump 158 and then through heater 115 before its return to contactor 116, thereby providing heat and agitation to the contents of the contactor. Any residual water and light hydrocarbons are removed from contactor 116 via line 159.

If desired, any one or two or all of contactors 106, 109 and 116 can be provided with jackets heated by steam or other source of heat to aid in maintaining the contents of the contactors at the desired temperatures. Any one or two or all of contactors 106, 109 and 116 can be equipped with stirrers to provide additional agitation, in an operable but presently less preferred arrangement, a stirrer in any one or more of the three contactors can be used instead of the recycle system employed with the corresponding one or more of the three contactors, any additional heating being provided by heaters in the line ahead of the contactors and/or by heated jackets around the contactors. Also, if desired, any one or two or all of conduits 103, 107 and 114 can feed into the recycle stream for contactors 106, 109 and 116, respectively, i.e., into conduits 152, 155 and 157, respectively, instead of directly into the respective contactor as shown. In one preferred technique the feed in conduit 102, rather than being passed directly into contactor 106, is passed into conduit 152 at the inlet side of pump 153. In a still more preferred technique, pump 153 is a high-volume pump that will cause the oil to flow in the turbulent flow range so as to promote heat transfer and decrease scaling in the conduit 152.

In accordance with the present invention, the oil from contactor 116 is passed via conduit 117 and into contactor 164 which contains a large volume of the oil having a temperature in the range of about 300° C. to about 420° C. The oil from 116 is passed into the oil in contactor 164 in such a manner that the temperature of the oil is not raised above about 200° C. prior to contacting the oil in contactor 164. More preferably the oil from 116 is not heated to a temperature as high as 150° C. before it is passed into the heated oil of contactor 164.

In the prior art commercial operation, heater 163 included a furnace through which the oil traveled in a heating coil so that its temperature could be raised to the heat soak temperature. In accordance with the present invention, the heater 163 is not needed. If desired, a heat exchanger other than a furnace could be employed as heater 163 to provide a slight heating action to the oil in line 117.

The oil in the heat soak vessel 164 is removed via line 165 and pumped by pump 166 to heater 167 which is a furnace through which the oil travels in a heating coil wherein the oil is heated to a temperature at least as high as the heat soak temperature and then recycled to heat soak vessel 164. Although the invention is not intended to be limited by theory, it is considered that the improvement obtained using this invention is due to the fact that the oil passing from vessel 116 contains materials which when first exposed to the heat soak temperature form decomposition products which adhere to the walls of tubing and eventually lead to plugging of the tubing. By allowing the oil to be heated to the heat soak temperature by a large volume of oil already having been heated in the furnace, the decomposition products do not have a chance to adhere to the walls of the smaller conduits of the system.

The necessary volume of hot oil needed in contactor 164 is related to the amount of residence time needed for the heat soak reaction. Accordingly, the volume will vary with the temperature selected for the heat soak reaction, with larger volumes, i.e., larger residence times, being required for the lower temperatures. For example, at a heat soak temperature of about 650° F. (340° C.), a residence time in the range of about 30 to 90 minutes would generally be desirable. Thus, if the feed from 116 were being supplied to 164 at a rate of 20 gallons per minute, it would be preferred to have about 1,200 gallons of hot oil in 164 if a residence time of 1 hour was to be provided. Most preferably, the volume of hot oil in 164 in gallons would be in the range of about 30 to 90 times the number of gallons of oil supplied to 164 per minute from 117. If it is found desirable to increase the residence time, a larger heat soak vessel can be employed or a plurality of vessels can be employed to allow for the use of larger volumes of heated oil.

The ratio of rate of oil recycled through furnace 167 to the oil provided via line 117 does not appear to particularly affect the reaction taking place in heat soak vessel 164. The recycle ratio is thus mainly dependent upon the nature of the design parameters of the heating furnace. Typically, ratios of recycle to feed in the range of 3/1 to 16/1 can be employed, preferably in the range of about 4/1 to 10/1.

As in the prior commercial operation, residual water and light components can be removed from heat soak vessel 164 via line 168. The treated oil from contactor 164 is passed through conduit 169 through a cooler 170 wherein the oil is cooled to a temperature in the range of about 150° to about 180° C. and then passed into a fifth contactor 171 wherein it is admixed with filter aid provided via conduit 118, preferably as a slurry in light hydrocarbons provided from makeup tank 119. In a presently, preferred embodiment, not illustrated, the oil from contactor 164 is cooled at least in part as a result of passing in indirect heat exchange with the feed passing through line 102 whereby the heat in the oil in line 120 is used to heat the feed oil in line 102.

Following admixture of filter aid, the resulting mixture is passed via line 172 to filter 121, which optionally can be precoated with filter aid. The use of the heat soak step of the present invention can in many cases result in a reduction in the amount of filter aid required for a suitable filtration rate.

Filter cake from filter 121 is removed via line 147 and optionally passed to furnace 148 from which, following burning or calcination, at least a portion of the resulting ash containing filter aid can be passed to waste via line 149 or recycled via conduits 120 and 160 to slurry makeup tank 119 for further use in the system. Fresh filter aid is added through conduit 160. Light hydrocarbons for use in preparing the slurry can be recovered from the integrated process and can be passed to tank 119 via conduit 151.

The filtered oil, being essentially free of ash-forming constituents previously contained therein, is suitable for a variety of industrial uses and, if desired, can be removed from the system via line 123.

However, in the presently preferred integrated process of this invention, the hot oil flowing filtration is passed via line 122 to heater 125 in order to raise the oil to a temperature in the range of 200° to 480° C. for further processing. If desired, a first portion of hydrogen is added thereto via line 124. The resulting hot oil containing the added hydrogen is then passed throug contactor 126 wherein decomposition is effected of the sulfonates contained in the oil.

While it is presently preferred that contactor 126 contain bauxite or an activated carbon adsorbent bed therein, this unit can employ other adsorbents such as those selected from the group consisting of silica gel, clay, activated alumina, combinations thereof, and the like. The adsorbent serves to effect breakdown and decomposition of the ammonium salts of sulfonic acids and the ashless detergents contained in the oil. The adsorbent further serves to collect a small portion of the resulting products and thus precludes passage of such undesirable decomposition products to the hydrotreater. Such adsorbents can be regenerated by conventional means and reused.

Preferably, the adsorbent contains about 0.2 to about 20 weight percent of at least one metal selected from the group consisting of Group VIB and Group VIII metals, this weight percent being based on the total weight of modified adsorbent. This modified adsorbent can be prepared by impregnation of the adsorbent with an aqueous solution of a water-soluble compound of a Group VIB or Group VIII metal, followed by evaporation of water. Water-soluble compounds presently preferred for this use are iron compounds such as ferric ammonium oxalate, ferric ammonium citrate, ferric sulfate, and ferrous ammonium sulfate.

The resulting treated oil is thereafter passed from contactor 126 via line 127 to hydrotreater 128, which is maintained at an elevated temperature, which serves to effect destruction of the various additive systems previously added to the original oil stock. Hydrogen for the desired hydrotreating reaction is introduced to the system via line 129 in communication with line 127 or, if desired, directly to the hydrotreater 128.

In hydrotreater 128 the oil is subjected to hydrogenation conditions in the presence of a catalyst so as to hydrogenate unsaturated materials and to effect decomposition of residual sulfur, oxygen and nitrogen bodies so as to yield an oil product suitable for further purification to a lube stock.

Suitable catalysts for use in hydrotreater 128 are those selected from the group consisting of Group VIB and Group VIII metals and combinations thereof, on a refractory support, used in conventional hydrodesulfurization processes.

Following hydrotreating, the resulting oil is passed via conduit 130 to separator-reflux column 131 which serves to remove water and various other by-products of the previous treatments from the oil. If desired, and particularly when HCl is present, water can be injected into column 131 to aid in removal of most of any HCl and part of the $H_2S$ and $NH_3$ as water-soluble salts. Overhead from column 131 comprising hydrogen, $H_2S$, $NH_3$, and water is passed via line 132 to sulfur removal unit 133. This unit, for example, a bed of zinc oxide, serves to remove $H_2S$ (sulfur) from the hydrogen stream. The resulting sulfur-free hydrogen stream is thereafter passed via line 134 to cooler 135. Ammonia is then removed, for example, by water washing in an ammonia removal unit (not shown) in conduit 136. Hydrogen is then recycled via conduit 136 to line 129.

An example of another material useful in unit 133 is iron oxide. Alternatively, a solvent process can be employed using substances such as alkanolamines and/or other amines, the $H_2S$ subsequently being oxidized to sulfur in a Claus-type process.

The bottoms product from column 131 is passed via line 137 to lubestock stripper 138 wherein a further steam treatment is carried out by introduction of steam via line 139.

Stripping, preferably steam stripping, of the oil is essential to the integrated process of this invention since it served to remove those light hydrocarbon products boiling below the oil, such as kerosene or heavy gasoline, which have remained entrained in the oil or which are by-products of the hydrogenation treatment. Alternatively, gas stripping such as with hydrogen can be employed.

The resulting hot stripped product, consisting essentially of a pure lube oil stock, following cooling such as by use in heat exchanger 125, is thereafter passed via line 141 to a lube oil stock product tank (not shown) for storage and subsequent use as an additive-free lube oil stock suitable for reformulation with additives as desired.

Overhead from stripper 138, which consists essentially of fuel oil and water, is passed via line 142 to settler 143, where a hydrocarbon phase 144 and a water layer 145 are allowed to form. The hydrocarbon layer 144 is removed via line 146 and combined, if desired, with the hydrocarbon phase in storage tank 113 for further use or recycled to filter aid makeup tank 119 via line 151. The small amount of gases present in line 146 can be removed by flashing.

Depending upon the feedstock, treating agent and other characteristics of a particular operation, as one skilled in the art in possession of this disclosure will understand, the specific conditions of operation given below can vary, preferably within the approximate ranges which are also given.

| Ref. No. | Unit Description | Typical | Approximate Preferred Ranges |
|---|---|---|---|
| 103 | Heater | Temperature 95° C.<br>Pressure 17 psia | 60-120° C.<br>Atmospheric-250 psia |
| 104 | Treating Agent | Weight ratio agt:oil 0.01:1 | 0.005-0.05:1 |
| 106 | Contactor | Temperature 95° C.<br>Pressure 17 psia<br>Time 30 minutes | 60-120° C.<br>Atmospheric-50 psia<br>10 minutes-2 hours |
| 109 | Contactor | Temperature 125° C.<br>Pressure 16 psia<br>Time 30 minutes | 110-140° C.<br>5-25 psia<br>10 minutes-2 hours |
| 116 | Contactor | Temperature 160° C.<br>Pressure 16 psia<br>Time 30 minutes | 140-200° C.<br>5-25 psia<br>10 minutes-2 hours |
| 111 | Phase Separator | Temperature 40° C.<br>Pressure atmospheric | 0-80° C.<br>Atmospheric-45 psia |
| 165 | Contactor | Temperature 360° C.<br>Pressure atmospheric<br>Time 30 minutes | 300-420° C.<br>Atomospheric-50 psia<br>5 minutes-2 hours |
| 171 | Contactor | Temperature 150° C.<br>Pressure atmospheric<br>Time 30 minutes | 100-180° C.<br>Atmospheric-25 psia<br>10 minutes-2 hours |
| 121 | Filter | Temperature 115° C.<br>Pressure differential plate and frame filter 80 psi<br>Continuous rotary drum filter 10 psi | 60-200° C.<br>5-100 psi<br>2-14 psi |
| 148 | Furnace | Temperature 760° C.<br>Pressure atmospheric | 650-870° C.<br>Substantially atmospheric |
| 118 | Filter Aid | Weight ratio aid:oil 0.01:1 | 0:1-0.15:1 |
| 124 | Hydrogen Charge | 111 vol/vol oil | 80-3000 vol/vol oil |
| 125 | Heater | Temperature 370° C.<br>Pressure 735 psia | 200-480° C.<br>150-3000 psia |
| 126 | Contactor | Temperature 370° C.<br>Pressure 735 psia | 200-480° C.<br>150-3000 psia |
| 128 | Hydrotreater | Temperature 360° C.<br>Pressure 730 psia | 200-430° C.<br>150-3000 psia |
| 129 | Hydrogen Charge | 222 vol/vol oil | 80-3000 vol/vol oil |
| 131 | Reflux | Temperature 325° C.<br>Pressure 705 psia | 290-400° C.<br>600-800 psia |
| 133 | Sulfur Removal Unit | Temperature 290° C.<br>Pressure 700 psia | 150-430° C.<br>100-3000 psia |
| 135 | Cooler | Inlet temperature 290° C.<br>Outlet temperature 55° C. | 260-370° C.<br>40-95° C. |
| 138 | Stripper | Temperature 370° C.<br>Pressure 20 psia | 280-395° C.<br>Atmospheric-50 psia |
| 143 | Settler | Temperature 55° C.<br>Pressure 16 psia | 0-80° C.<br>Atmospheric-45 psia |

What is claimed is:

1. In a process for the production of an essentially ash-free oil stock from a lubricating oil containing ash-forming components wherein the process comprises:

(a) contacting said lubricating oil with an aqueous solution of a treating agent comprising a suitable ammonium salt under conditions sufficient to dispense said agent in said lubricating oil and to react said agent with ash-forming components of said lubricating oil;

(b) removing a major portion of the water from the mixture resulting from combining said aqueous solution and said lubricating oil;

(c) heating at least a portion of the product resulting from step (b) in the temperature range of about 300° to about 420° C. for a period of time sufficient to increase the amount of ash-forming components that can be removed from the oil;

(d) cooling the product from step (c) to a temperature in the range of about 100° to about 180° C.; and (e) separating solids from the product of step (d);

the improvement comprising conducting step (c) by passing the oil from step (b) into a soaking vessel containing a large volume of said oil having a soaking temperature in the range of about 300° C. to about 420° C. before the oil from step (b) is heated to a temperature higher than 200° C. and passing portions of said large volume of oil through a heating coil wherein said oil is heated to a temperature in the range of 300° C. to 420° C. and recycled to said soaking vessel wherein the residence time for the oil in said soaking vessel is such that the fouling of the heating coil is less than it would be if the oil from step (b) were heated to the same temperature by being passed directly through the heating coil.

2. A process according to claim 1 wherein the oil from step (b) is passed into said large volume of oil before the oil from step (b) is heated to a temperature higher than 150° C.

3. A process according to claim 2 wherein said large volume of oil is at a temperature in the range of 320° C. to 360° C.

4. A process according to claim 3 wherein the volume of said large volume of oil in gallons is about 30 to about 90 times the number of gallons of oil from step (b) that is supplied to the large volume of oil per minute.

5. A process according to claim 4 wherein the ratio of oil recycled through the heating coil to oil supplied from step (b) is in the range of about 3/1 to 16/1.

6. In a process for producing an essentially ash-free oil stock from a lubricating oil containing ash-forming components comprising:

reacting the oil with an aqueous ammonium salt capable of reacting with the ash-containing components and heating the thus treated oil at a temperature in the range of about 300° C. to about 420° C. for a period of time sufficient to increase the amount of the ash-forming components removed, the improvement comprising not exposing the oil to a temperature greater than 200° C. before the oil is passed into a large volume of the oil already at a temperature in the range of about 300° C. to about 420° C.

7. A process according to claim 6 wherein the oil is not exposed to a temperature higher than 150° C. before it is passed into said large volume of heated oil.

8. A process according to claim 7 wherein said large volume of oil is at a temperature in the range of 320° to 360° C.

9. A process according to claim 8 wherein the volume of said large volume of oil in gallons is about 30 to about 90 times the number of gallons of oil that is supplied to the large volume of oil per minute.

* * * * *

UNITED STATES PATENT AND TRADEMARK OFFICE

CERTIFICATE OF CORRECTION

PATENT NO. : 4,420,389

DATED : December 13, 1983

INVENTOR(S) : Alden E. Beckworth et al

It is certified that error appears in the above-identified patent and that said Letters Patent is hereby corrected as shown below:

Column 9, lines 51-52, "dispense" should read --- disperse ---.

Signed and Sealed this

*Twentieth* Day of *March 1984*

[SEAL]

*Attest:*

GERALD J. MOSSINGHOFF

*Attesting Officer*

*Commissioner of Patents and Trademarks*